US006568358B1

(12) United States Patent
Hoerl et al.

(10) Patent No.: US 6,568,358 B1
(45) Date of Patent: May 27, 2003

(54) MULTICYLINDER INTERNAL COMBUSTION ENGINE WITH GAS FLOW LIFT VALVES ACTUATED BY ELECTRO-MAGNETIC ACTUATORS

(75) Inventors: Albert Hoerl, Taufkirchen (DE); Adelbert Grudno, Groebenzell (DE); Volker Warnecke, Nittendorf/Pollenried (DE); Ferdinand Loebbering, Alteglofsheim (DE)

(73) Assignees: Bayerische Motoren Werke Aktiengesellschaft, Munich (DE); Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/914,253

(22) PCT Filed: Jan. 7, 2000

(86) PCT No.: PCT/EP00/00064

§ 371 (c)(1),
(2), (4) Date: Dec. 12, 2001

(87) PCT Pub. No.: WO00/50741

PCT Pub. Date: Aug. 31, 2000

(30) Foreign Application Priority Data

Feb. 24, 1999 (DE) ..... 199 07 850

(51) Int. Cl.[7] ..... F01L 9/04

(52) U.S. Cl. ..... 123/90.11; 123/41.82 R; 123/432; 123/315; 123/41.31; 123/90.1

(58) Field of Search ..... 123/90.1, 90.11, 123/90.23, 315

(56) References Cited

U.S. PATENT DOCUMENTS 5,113,805 A * 5/1992 Kawamura ..... 123/21
5,193,492 A * 3/1993 Kawamura ..... 123/90.11
5,517,951 A * 5/1996 Paul et al. ..... 123/90.11
5,775,276 A * 7/1998 Yanai et al. ..... 123/90.11
5,782,211 A * 7/1998 Kamimaru ..... 123/90.11
5,915,347 A * 6/1999 Yanai et al. ..... 123/90.11
5,941,202 A * 8/1999 Shimizu et al. ..... 123/90.11
6,176,208 B1 * 1/2001 Tsuzuki et al. ..... 123/90.11
6,269,784 B1 * 8/2001 Newton ..... 123/90.11

FOREIGN PATENT DOCUMENTS

| | | |
|---|---|---|
| DE | 42 25 329 A1 | 2/1993 |
| DE | 196 11 547 A1 | 9/1997 |
| DE | 198 01 396 C1 | 3/1999 |
| DE | 198 14 803 A1 | 10/1999 |

* cited by examiner

*Primary Examiner*—Noah P. Kamen
*Assistant Examiner*—J O Benton
(74) *Attorney, Agent, or Firm*—Crowell & Moring LLP

(57) ABSTRACT

The invention relates to a multi-cylinder internal combustion engine with gas flow lift valves actuated by electromagnetic actuators and controlling the intake and the exhaust of the cylinder combustion chambers. The cross-sectional area of the actuators allocated to the intake lift valves which is perpendicular to the axial direction of the lift valves is smaller than the cross-sectional area of the actuators allocated to the exhaust lift valves. If the intake lift valves and the exhaust lift valves are arranged in series one after the other in the direction of the longitudinal axis of the internal combustion engine, the width of the intake actuators measured in the plane of the actuator cross-sectional area and perpendicular to the longitudinal axis of the internal combustion engine is smaller than that of the exhaust actuators. If two intake lift valves and two exhaust lift valves each are provided per cylinder, the distance between the two cylinder exhaust lift valves measured in the direction of the longitudinal axis of the internal combustion engine equals the distance between the two cylinder intake lift valves. An ignition spark provided between the plane of the exhaust lift valves and the plane of the intake lift valves is at least slightly inclined towards the intake actuators with its longitudinal axis.

26 Claims, 2 Drawing Sheets

Figure 1:
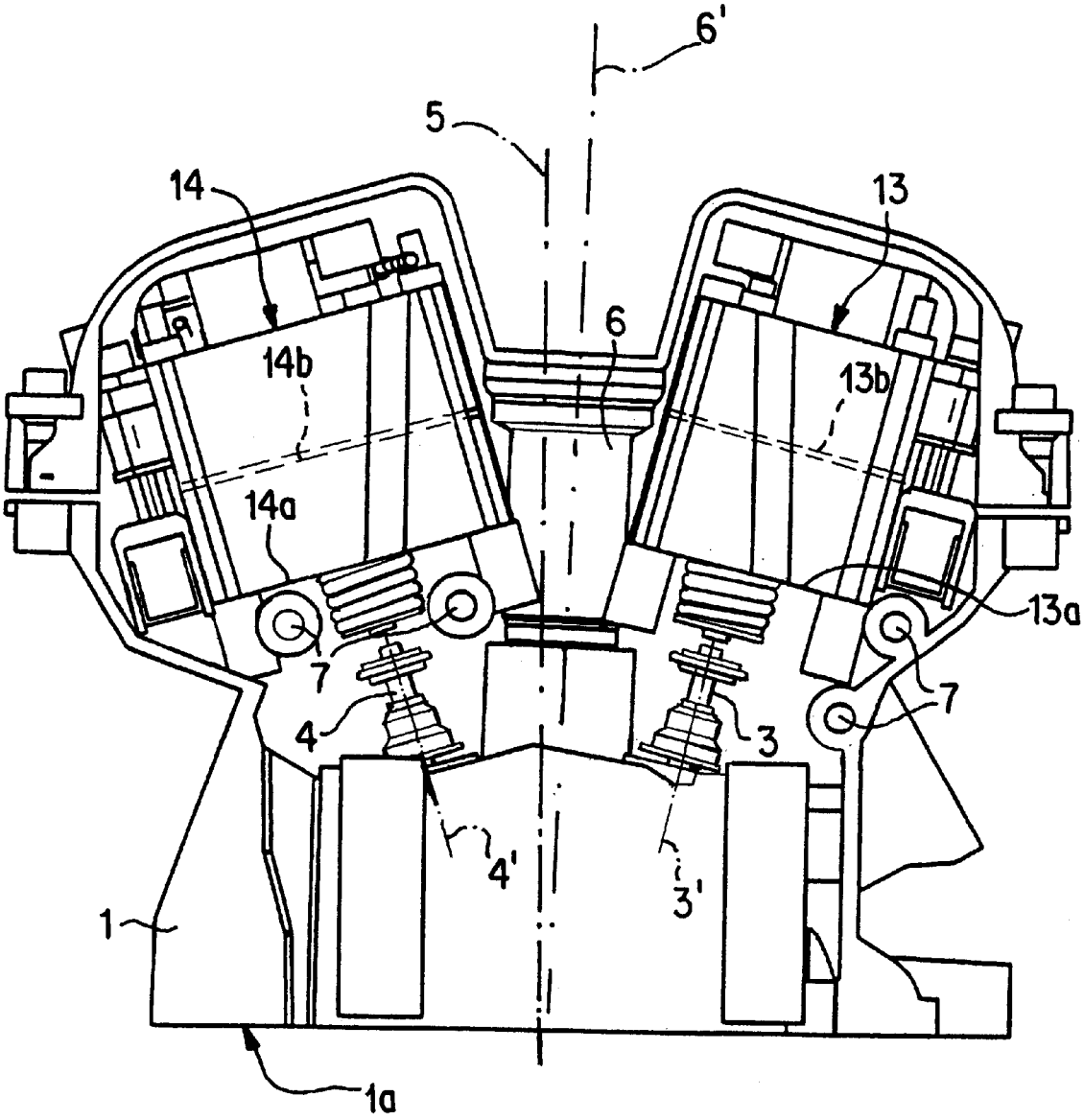

MULTICYLINDER INTERNAL COMBUSTION ENGINE WITH GAS FLOW LIFT VALVES ACTUATED BY ELECTRO-MAGNETIC ACTUATORS

This invention relates to a multi-cylinder combustion engine with gas exchange upper valves that are moved by electromagnetic actuators and that control the intake as well as the discharge of the cylinder combustion chambers. Reference is made to DE 196 11 547 A1, by way of example, regarding the technical environment.

An electromagnetic upper valve moving device for a combustion engine, also called electromagnetic actuator, offers tremendous advantages due to the freedom regarding the valve control times, that is to say, regarding the particular opening and closing moment of the upper valves; but for movement purposes, in particular, for the purpose of opening the upper valve, one must apply relatively strong forces and that necessitates a certain minimum size for the magnetic coils and the armature. As a result, it is extremely difficult to house the known actuators in a currently customary cylinder head, for example, in a combustion engine that drives a motor vehicle. This problem applies even more so in the case of combustion engines that have two or more intake valves or discharge valves per cylinder.

The invention at hand is intended to point out measures that will contribute to the solution of the complex problem just described.

The solution of this problem is characterized by the following: The cross-section surface of the actuators associated with the intake upper valves, which is positioned perpendicularly to the axial direction of the upper valves, is smaller than the corresponding cross-section surface of the actuators that are associated with the discharge upper valves. Advantageous forms and developments are covered in the subclaims.

The invention deviates from the hitherto-customary equal-parts concept; in other words, the following is proposed: In place of the hitherto-customary procedure, where equally dimensioned actuators were provided for the intake upper valves as well as the discharge upper valves, the actuators now are adapted to the particular upper valves to be moved in terms of their discharge capacity and thus also regarding their special geometric dimensions. It was found that to move an intake upper valve of a combustion engine, one requires less forces than for moving a combustion engine discharge upper valve. Here is the reason why: An opening motion of the intake upper valves is paralleled by an intake suction stroke of the combustion engine during which the cylinder volume, for example, in the case of a reciprocating piston combustion engine, is enlarged by the (so to speak, downward-directed) suction stroke of the cylinder piston. The resultant pressure drop supports an opening motion of the intake upper valves. On the other hand, when the discharge upper valves are opened, they are opened at the over-pressure that at this point in time still prevails in the cylinder, as a result of which, one can clearly understand that, upon the opening of a discharge upper valve, one must do more work than when the intake upper valve is opened.

The work capacity of an electromagnetic actuator that moves an upper valve is determined directly via the magnitude of the magnetic coils arranged in the actuator (including the sheet metal stampings as well as the armature that is moved in an oscillating manner between the magnetic coils and that in the final analysis acts upon the upper valve). This means that an actuator that must do less work can also have a smaller cross-section surface perpendicularly to the axial direction of the upper valve to be moved than an actuator that must perform comparatively heavier work. It is precisely this interrelationship that is shown in the characterizing features of claim 1.

Figure 2:
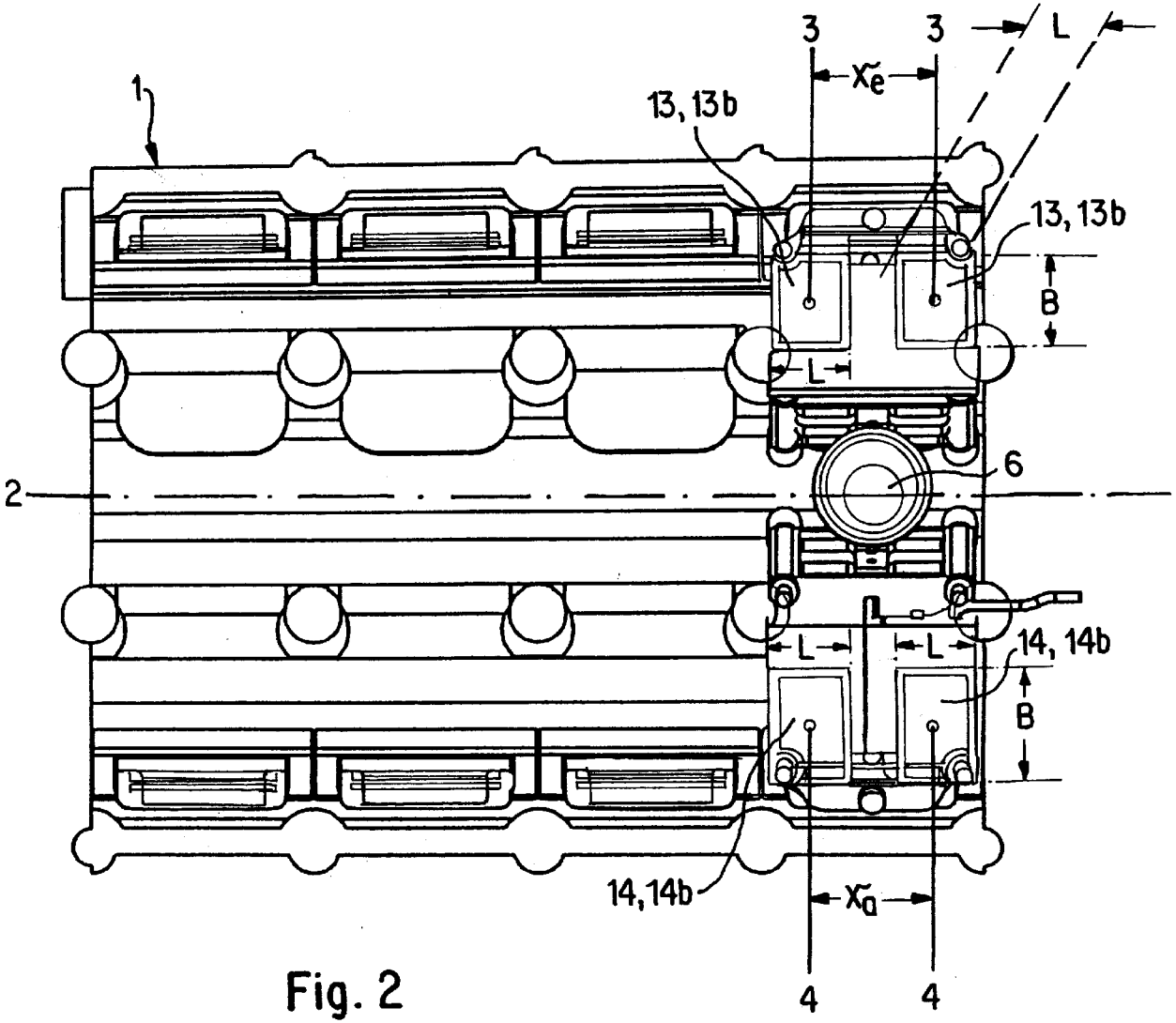

On the basis of this knowledge, one can then design the combustion engine or, more precisely, its cylinder head (or a component thereof) in which are arranged the upper valves as well as the actuators moving these upper valves also in terms of a space-saving design. This and other advantageous designs can also be seen in the following explained preferred exemplary embodiment of the invention of which FIG. 1 shows a profile through the cylinder head of an invention-based combustion engine; on the other hand, FIG. 2 shows a top view (according to arrow X from FIG. 1), looking down upon the cylinder head. All of the features, described in greater detail, can be essential to the invention; for the moment, it must be expressly pointed out that, although the invention will be explained below with the help of a four-cylinder series combustion engine, the invention naturally can also be implemented on a combustion engine of some other model or with a different number of cylinders.

The reference number 1 refers to the cylinder head of a reciprocating piston combustion engine, in this case with four cylinders, that is to say, in the direction of the longitudinal axis 2 of the combustion engine (in FIG. 1, this longitudinal axis 2 is positioned perpendicularly to the plane of the drawing), four combustion engine cylinders are arranged, one behind the other. Associated with each cylinder are two intake upper valves 3 as well as two discharge upper valves 4 via which the gas exchange of the cylinder is controlled, that is to say, fresh gas is moved via the intake upper valves into the particular cylinder combustion chambers, whereas the burned exhaust gas is evacuated via the discharge upper valves 4.

All intake upper valves 3 of the combustion engine are arranged in a series, one behind the other, in the direction of the longitudinal axis 2 of the combustion engine; by the same token, all discharge upper valves 4 of the combustion engine are arranged behind each other in another row in the direction of the longitudinal axis 2 of the combustion engine. In the illustration according to FIG. 1, the intake upper valves 3 are located on the right, and the discharge upper valves 4 are located on the left. In the illustration according to FIG. 2, the intake upper valves 3 are located in the upper half of the picture; that is to say, above the longitudinal axis 2 that runs through the middle of the combustion engine or the cylinder head 1; the discharge upper valves are located in the lower half of the picture; that is to say, below the longitudinal axis 2. The illustration according to FIG. 2 displays only the intake upper valves 3 and the discharge upper valves 4 of the first cylinder, which is located (here on the right) outside of the four-cylinder combustion engine; [this is also shown] merely in a simplified form, showing the particular valve axis that is illustrated as a dot (due to the top view), which, for the sake of simplicity, is also labeled with the particular reference number 3 or 4. In the illustration according to FIG. 1, on the other hand, the axial direction of the upper valves 3 or 4 is labeled with reference numbers 3' or 4'.

Upper valves 3, 4 are moved by electromagnetic actuators 13, 14 that are associated with these valves and whose detailed structure will not be explained here in any greater detail because, on the one hand, the expert is familiar with this and, on the other hand, it can essentially be so designed as shown in the initially mentioned DE 196 11 547 A1. These actuators 13, 14 are above the particular upper valves 3, 4 and, like the latter with respect to the vertical axis 5 of the combustion engine, are arranged in a manner slightly inclined outward, in which the vertical axis is positioned perpendicularly on the bottom 1*a* of cylinder head 1 (and on the plane of the drawing in the illustration according to FIG. 2), with said bottom la facing toward the combustion engine crankcase, which is not shown. With their undersides 13*a* or 14*a,* actuators 13 or 14 are thus positioned perpendicularly upon the axial directions 3' or 4' of the upper valves 3 or 4.

For further explanation, there is defined a so-called cross-section surface 13*b* or 14*b* of actuators 13 or 14, which extends perpendicularly to the axial direction 3' or 4' and thus parallel to the particular underside of 13*a* or 13*b* of an actuator 13 or 14. Looking at FIG. 1, of course, only the width of the cross-section surface 13 or 14, which extends perpendicularly to the longitudinal axis 2 of the combustion engine, can be illustrated. This dimension of the width of the cross-section surface 13 or 14 is labeled with the letter B in FIG. 2. In addition to this, FIG. 2 also shows the longitudinal dimension L of each actuator 13 or 14, measured in the direction of the longitudinal axis 2; [this actuator], as also shown in FIG. 2, has an essentially rectangular cross-section surface 13*b* or 14*b*.

As shown in FIG. 2, the interval $x_a$ in the direction of the longitudinal axis 2 of the combustion engine, measured between the two cylinder discharge upper valves 4, is equal to the interval $x_e$ in the direction of the longitudinal axis 2 of the combustion engine, measured between the two cylinder intake upper valves 3. Accordingly, it is possible to design actuators 14 of the discharge upper valves 4 as well as actuators 13 of the intake upper valves 3 so that the actuators 13 and 14 will have an essentially identical length L (measured in the direction of longitudinal axis 2 of the combustion engine).

As indicated particularly clearly in FIG. 1 but also in FIG. 2, the width dimension B of actuators 13, associated with intake upper valves 3, however, is less than the width B of actuators 14 that are associated with discharge upper valves 4. Accordingly the cross-section surface 13*b* of actuators 13 is smaller than the cross-section surface 14*b* of actuators 14.

As was explained in greater detail earlier by way of example prior to the description of the figures applying to this preferred embodiment example, the cross-section surface 13*b* of the so-called intake actuators 13 can be less than that of the so-called discharge actuators 14 since the work or output to be provided by the first-mentioned ones during the course of an opening motion of the intake upper valves 4 is less than the work or performance to be provided by the last-mentioned ones in the course of an opening movement of the discharge upper valves 4. Through this measure, of course, one deviates from a fundamentally desired equal-parts concept; that is to say, the discharge actuators 14 will differ from the intake actuators 13, but, on the other hand, through this measure, one achieves significant advantages regarding the necessary structural space.

These advantages are obvious and really do not require any further explanation. The essential aspect here is that the electromagnetic actuators 13 or 14, associated with the particular upper valves 3 or 4, are dimensioned with a view of the work they are expected to do, and their size is determined especially also regarding their outer geometric dimensions; that is to say, in this case, regarding their cross-section surfaces 13*b* or 14*b*. Now, as explained initially, if for the smaller cross-section surface 13*b* and especially the intake actuators 13, which have a smaller width dimension B, a lesser structural space is required than for the discharge actuators 14 that by comparison are larger or wider, then this gain of structural space can be used in another way or the entire structural space required for the combustion engine as a whole can be correspondingly reduced.

This is also the sense in which one must understand another measure: it is implemented in the preferred exemplary embodiment illustrated in FIGS. 1 and 2. A spark plug dome 6 for the purpose of receiving a spark plug, not shown in the figure—provided between the plane of all discharge double valves 4 extending between [and] in the direction of the longitudinal axis 2 of the combustion engine as well as the corresponding plane of all intake upper valves 3—has a longitudinal axis 6*a* that is at least slightly inclined toward the intake actuators 13; the point of intersection of this longitudinal axis with the cylinder combustion chamber, not shown, lies essentially in the center of the combustion chamber. Here, naturally, each cylinder of the multi-cylinder combustion engine has such a spark plug dome 6, although such a [dome] is shown in FIG. 2 only for the first cylinder (which is located on the right side). The longitudinal axis 6*a* of the spark plug dome 6, which comes to coincide with the longitudinal axis of the installed spark plug, not shown, thus is slightly inclined toward the intake actuators 13 with respect to the vertical axis 5 of the combustion engine, as is shown especially in FIG. 1. This spark plug dome 6, when it is observed in the direction of the longitudinal axis 2 of the combustion engine, is arranged essentially between the two intake upper valves 3 (as well as between the two discharge upper valves 4) of each combustion engine cylinder. This measure likewise brings about a reduction in the total width of the combustion engine (in FIG. 2, measured perpendicularly to the longitudinal axis 2, and in FIG. 1, measured perpendicularly to the vertical axis 5); this is quite obvious.

Due to the described compact and space-saving arrangement in the cylinder head of the combustion engine, which basically is extremely advantageous, it may, however, be necessary to see to the adequate cooling of actuators 13, 14, which naturally, when in operation, generate a considerable volume of waste heat. Simple air cooling of the electromagnetic actuators 13, 14 would seem to suffice in very few cases; this is why supportive measures are provided here. These measures consist of the following: there are provided compressed oil ducts 7 near the underside 13*a* or 14*a* of actuators 13 or 14, which ducts essentially extend in the direction of longitudinal axis 2 of the combustion engine and cylinder head 1 and with which underside these actuators rest on cylinder head 1. The heat volume generated in actuators 13, 14 is thus for the most part transferred via their underside 13*a* or 14*a* to cylinder head 1 and, in the latter, it is evacuated via the lubricating oil of the combustion engine that is carried in compressed oil ducts 7. A part of this lubricating oil, moved in compressed oil duct 7, can also be conveyed through the electromagnetic actuators 13, 14, specifically not just for lubricating purposes but also for increased cooling of said actuators (not illustrated in the figures).

Additional measures to increase the cooling of the actuators, which will be mentioned briefly, are likewise not shown in the figures. For example, near the underside 13*a* or 14*a* of actuators 13 or 14 with which these actuators rest on cylinder head 1, there can be a relatively large accumulation of material forming cylinder head 1 so that this material can absorb a large volume of waste head generated on the actuators. Furthermore, near the underside 13*a* or 14*a* of actuators 13 or 14 with which these actuators rest on cylinder head 1, there can be provided in cylinder head 1 certain coolant chambers for a cooling flowing through the cylinder head. Of course, one can also provide a plurality of additional details, in particular, of a design nature that certainly deviates from the exemplary embodiment shown without departing from the content of the patent claims.

LIST OF REFERENCE

1 Cylinder head
1*a* Bottom of 1
2 Longitudinal axis of combustion engine
3 Intake upper valve
3' Axial direction of 3
4 Discharge upper valve
4' Axial direction of 4
5 Vertical axis of combustion engine
6 Spark plug dome
6' Longitudinal axis of 6
7 Compressed oil duct
13 Actuator for 3 (=intake actuator)
13*a* Underside of 13
13*b* Cross-section surface of 13
14 Actuator for 4 (=discharge actuator)
14*a* Underside of 14
14*b* Cross-section surface of 14
B Width/width dimension of 13*b* or 14*b*
L Length/length dimension of 13*b* or 14*b*
$x_a$ Interval between the two discharge upper valves 4 of a cylinder
$x_e$ Interval between the two intake upper valves 3 of a cylinder

What is claimed is:

1. Multi-cylinder combustion engine with gas exchange upper valves that are moved by electromagnetic actuators and that control the intake as well as the discharge of the cylinder combustion chambers, wherein the cross-section area of the actuators, associated with the intake upper valves positioned perpendicularly to the axial direction of the upper valves, are less than the corresponding cross-section area of the actuators associated with the discharge upper valves.

2. Combustion engine according to claim 1, wherein the intake upper valves as well as the discharge upper valves are arranged in a series in the direction of longitudinal axis of the combustion engine, wherein the width of the intake actuators, measured in a plane of the actuator cross-section area and perpendicularly to the longitudinal axis of the combustion engine, is smaller than the corresponding width of the discharge actuators.

3. Combustion engine according to claim 1 having two intake upper valves and discharge upper valves per cylinder, wherein an interval, measured in the direction of a longitudinal axis of the combustion engine between the two cylinder discharge upper valves, is equal to a corresponding interval between the two cylinder intake upper valves.

4. Combustion engine according to claim 2 having two intake upper valves and discharge upper valves per cylinder, wherein an interval, measured in the direction of a longitudinal axis of the combustion engine between the two cylinder discharge upper valves, is equal to a corresponding interval between the two cylinder intake upper valves.

5. Combustion engine according to claim 1, wherein a spark plug dome for the purpose of receiving a spark plug provided between the plane of the discharge upper valves as well as the plane of the intake upper valves has a longitudinal axis that is inclined at least slightly toward the intake actuators.

6. Combustion engine according to claim 2, wherein a spark plug dome for the purpose of receiving a spark plug provided between the plane of the discharge upper valves as well as the plane of the intake upper valves has a longitudinal axis that is inclined at least slightly toward the intake actuators.

7. Combustion engine according to claim 3, wherein a spark plug dome for the purpose of receiving a spark plug provided between the plane of the discharge upper valves as well as the plane of the intake upper valves has a longitudinal axis that is inclined at least slightly toward the intake actuators.

8. Combustion engine according to claim 1, further comprising compressed oil ducts that extend essentially in the direction of the longitudinal axis of the combustion engine in the combustion engine cylinder head near an underside of the actuators with which side these ducts rest on a cylinder head.

9. Combustion engine according to claim 2, further comprising compressed oil ducts that extend essentially in the direction of the longitudinal axis of the combustion engine in the combustion engine cylinder head near an underside of the actuators with which side these ducts rest on a cylinder head.

10. Combustion engine according to claim 3, further comprising compressed oil ducts that extend essentially in the direction of the longitudinal axis of the combustion engine in the combustion engine cylinder head near an underside of the actuators with which side these ducts rest on a cylinder head.

11. Combustion engine according to claim 5, further comprising compressed oil ducts that extend essentially in the direction of the longitudinal axis of the combustion engine in the combustion engine cylinder head near an underside of the actuators with which side these ducts rest on a cylinder head.

12. Combustion engine according to claim 1, wherein near an underside of the actuators with which side these actuators rest on the cylinder head, there is a relatively large accumulation of material forming the cylinder head.

13. Combustion engine according to claim 2, wherein near an underside of the actuators with which side these actuators rest on the cylinder head, there is a relatively large accumulation of material forming the cylinder head.

14. Combustion engine according to claim 3, wherein near an underside of the actuators with which side these actuators rest on the cylinder head, there is a relatively large accumulation of material forming the cylinder head.

15. Combustion engine according to claim 5, wherein near an underside of the actuators with which side these actuators rest on the cylinder head, there is a relatively large accumulation of material forming the cylinder head.

16. Combustion engine according to claim 8, wherein near an underside of the actuators with which side these actuators rest on the cylinder head, there is a relatively large accumulation of material forming the cylinder head.

17. Combustion engine according to claim 1, wherein near an underside of the actuators with which side these actuators rest on the cylinder head, there are provided coolant chambers in the cylinder head for a coolant that flows through the cylinder head.

18. Combustion engine according to claim 2, wherein near an underside of the actuators with which side these actuators rest on the cylinder head, there are provided coolant chambers in the cylinder head for a coolant that flows through the cylinder head.

19. Combustion engine according to claim 3, wherein near an underside of the actuators with which side these actuators rest on the cylinder head, there are provided coolant chambers in the cylinder head for a coolant that flows through the cylinder head.

20. Combustion engine according to claim 5, wherein near an underside of the actuators with which side these actuators rest on the cylinder head, there are provided coolant chambers in the cylinder head for a coolant that flows through the cylinder head.

21. Combustion engine according to claim 8, wherein near an underside of the actuators with which side these actuators rest on the cylinder head, there are provided coolant chambers in the cylinder head for a coolant that flows through the cylinder head.

22. Combustion engine according to claim 12, wherein near an underside of the actuators with which side these actuators rest on the cylinder head, there are provided coolant chambers in the cylinder head for a coolant that flows through the cylinder head.

23. A multi-cylinder combustion engine having gas exchange lift valves controlling an intake as well as a discharge of cylinder combustion chambers, comprising:

a plurality of electromagnetic actuators, wherein each actuator operates a respective gas exchange lift valve;

wherein said actuators associated with intake lift valves have cross-sectional areas, perpendicular to an axial direction of the intake lift valves, that are less than corresponding cross-sectional areas of the actuators associated with discharge lift valves.

24. The combustion engine according to claim 23, wherein the intake lift valves and the discharge lift valves are arranged in series in a longitudinal direction of the combustion engine, a width of the actuators associated with the intake lift valves measured in a plane of the cross-sectional area perpendicular to the longitudinal direction of the combustion engine being smaller than a corresponding width of the actuators associated with the discharge lift valves.

25. The combustion engine according to claim 23, wherein two intake lift valves and discharge lift valves are provided per cylinder combustion chamber; and wherein an interval in the longitudinal direction of the combustion engine between the two discharge lift valves for the cylinder is equal to a corresponding interval between the two intake lift valves for the respective cylinder.

26. The combustion engine according to claim 24, wherein two intake lift valves and discharge lift valves are provided per cylinder combustion chamber; and wherein an interval in the longitudinal direction of the combustion engine between the two discharge lift valves for the cylinder is equal to a corresponding interval between the two intake lift valves for the respective cylinder.

* * * * *